US005875907A

United States Patent [19]

Lay

[11] Patent Number: 5,875,907

[45] Date of Patent: Mar. 2, 1999

[54] TAMPER-EVIDENT DISPENSING CLOSURE FOR A CONTAINER

[75] Inventor: Dieter F. Lay, Oconomowoc, Wis.

[73] Assignee: AptarGroup, Inc., Crystal Lake, Ill.

[21] Appl. No.: 877,292

[22] Filed: Jun. 17, 1997

[51] Int. Cl.[6] ..... B65D 47/08

[52] U.S. Cl. ..... 215/253; 215/250; 215/901; 220/335; 220/337; 220/339; 220/239; 220/266; 220/DIG. 34; 222/153.06

[58] Field of Search ..... 215/250, 253, 215/901; 220/DIG. 34, 335, 337, 339, 259, 256, 265, 266; 222/153.06

[56] References Cited

U.S. PATENT DOCUMENTS

| | | |
|---|---|---|
| 3,480,184 | 11/1969 | Landis . |
| 3,651,992 | 3/1972 | Hazard . |
| 4,142,650 | 3/1979 | Almouli . |
| 4,170,315 | 10/1979 | Dubach et al. . |
| 4,231,486 | 11/1980 | Bock . |
| 4,291,818 | 9/1981 | Nozawa et al. . |
| 4,361,250 | 11/1982 | Foster . |
| 4,362,253 | 12/1982 | Wortley et al. . |
| 4,371,088 | 2/1983 | Gach . |
| 4,397,400 | 8/1983 | Walter . |
| 4,431,110 | 2/1984 | Roth . |
| 4,460,100 | 7/1984 | Libit . |
| 4,462,504 | 7/1984 | Roth et al. . |
| 4,487,324 | 12/1984 | Ostrowsky . |
| 4,592,480 | 6/1986 | Hart et al. . |
| 4,595,123 | 6/1986 | Libit . |
| 4,610,371 | 9/1986 | Karkiewicz . |
| 4,711,363 | 12/1987 | Marino . |
| 4,711,372 | 12/1987 | Gach . |
| 4,721,210 | 1/1988 | Lawrence et al. . |
| 4,778,072 | 10/1988 | Newman . |
| 4,892,217 | 1/1990 | Shastal . |
| 4,941,592 | 7/1990 | Kitterman . |
| 4,974,735 | 12/1990 | Newell et al. ..... 215/250 X |
| 5,123,561 | 6/1992 | Gross . |
| 5,201,440 | 4/1993 | Gross . |

FOREIGN PATENT DOCUMENTS

| | | |
|---|---|---|
| 05 04 635 | 1/1996 | Germany . |
| 2 950 062 | 9/1996 | Germany . |
| 195 31 341 | 2/1997 | Germany . |

OTHER PUBLICATIONS

Abstract of 2 950 062 DE.

*Primary Examiner*—Stephen K. Cronin
*Assistant Examiner*—Robin Hylton
*Attorney, Agent, or Firm*—Rockey, Milnamow & Katz, Ltd.

[57] ABSTRACT

A closure is provided for a container. The closure has a body and a lid. The closure includes a tamper-indicating member connected to the body of the closure by an anchor member received in an anchor member-receiving aperture defined in the closure body. The tamper-indicating member is also connected along a frangible junction to the lid of the closure. A plug member extends from the tamper-indicating member and is receivable in a plug member-receiving aperture defined in the body. When the tamper-indicating member is depressed to force the plug member into the plug member-receiving aperture, the frangible junction is broken, and the tamper-indicating member is retained in its depressed position. This provides an indication that the closure may have been previously opened. Also, an overhanging portion of the lid can be readily engaged by a finger to facilitate opening of the lid relative to the body of the closure.

18 Claims, 3 Drawing Sheets

TAMPER-EVIDENT DISPENSING CLOSURE FOR A CONTAINER

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to tamper-evident systems for containers which must be altered in some fashion to obtain access to the container contents, the alteration being evidence that the container has been previously opened. The present invention is especially suited for a tamper-evident construction wherein a panel must be severed or separated to open the container.

BACKGROUND OF THE INVENTION AND TECHNICAL PROBLEMS POSED BY THE PRIOR ART

A variety of container closures have been developed or proposed wherein an initial opening of a lid or a dispensing spout structure provides visual evidence of such an occurrence—even after the lid or spout has been subsequently closed. U.S. Pat. No. 4,487,324 and No. 4,941,592 disclose closures which incorporate a locking band or tab that is attached to either the lid or body of the closure with a plurality of frangible webs so as to initially retain the closure lid to the body in the closed position. To initially open the closure, the user must break the frangible webs by pushing or pulling on a tab or band.

U.S. Pat. No. 5,201,440 describes a container closure which includes a body for mounting on a container. The body defines a dispensing orifice. A lid is disposed on the body for being moved between open and closed portions relative to the dispensing orifice. A tamper-indicating member is provided as a unitary extension from the lid. A first frangible web connects the member to the lid. An anchor is connected with a second frangible web to another portion of the tamper-indicating member, and the anchor is retained by the closure body. The tamper-indicating member includes a graspable pull tab which can be pulled to completely sever the frangible webs connecting the tamper-indicating member to the lid and to the anchor. This permits the lid to be opened while providing evidence of tampering with the closure.

While the above-discussed closures can function well for the purposes for which they have been designed, it would be desirable to provide an improved tamper-evident closure which could be readily fabricated with certain types of lids or flow control elements and which, prior to the initial opening, could blend in with, or enhance, the cosmetic appearance of the closure. It would also be desirable for such a tamper-evident closure to be easily molded as one piece, including lid, body, and tamper-indicating portion, and to be easily deployed after molding to its tamper-indicating ready condition for eventual delivery to a user.

Further, it would be advantageous if such an improved closure could be initially opened relatively easily by the user. After such an improved closure has been initially opened and then closed, the closure should furnish a very clear indication that it has been previously opened. It would also be desirable to provide an improved tamper-evident closure design that includes a tamper-indicating member which, when altered during opening of the closure, would not result in the creation of a separate scrap piece that would require disposal.

The present invention provides an improved tamper-evident or tamper-indicating closure which can accommodate designs having the above-discussed benefits and features.

SUMMARY OF THE INVENTION

The present invention provides a novel tamper-indicating dispensing structure which blends well with, and/or enhances, the cosmetic appearance of a container or a closure and yet can be easily manipulated by the user to permit the structure to be opened for dispensing. The structure of the invention gives a clear indication of an initial opening of the structure. The structure, if embodied as a closure, can be configured to be easily molded as a single piece which can be mounted on a container in a tamper-indicating ready condition, i.e., ready to be first opened by a user.

The features of the invention can be adapted for use in a variety of dispensing container or closure designs. In one embodiment, the features can be incorporated in a closure having a body suitable for mounting on a container.

According to one aspect of the invention, a tamper-indicating arrangement is provided for a container. The arrangement includes first and second portions, one of which is typically adapted to extend from the container. The two portions are at least partly or partially separatable to permit the dispensing of material out of the container.

In a preferred embodiment, the arrangement is embodied in a dispensing closure structure wherein the first portion is a lid of the closure structure, and the second portion is a body defining a dispensing orifice. In such a preferred embodiment, the body is typically adapted to be mounted on the container. However, the body could be formed as a unitary part of, or extension of, the container. The lid may be hinged to the body or may be a separate piece adapted to engage the body.

The tamper-indicating arrangement of the present invention further includes a tamper-indicating member which is connected to the first portion (e.g., the lid of a closure) and to the second portion (e.g., the body of a closure). The tamper-indicating member is connected to the first portion via a frangible web, joint, or junction. The tamper-indicating member is connected to the second portion to allow relative displacement between at least part of the tamper-indicating member and the first portion. The displacement is of a magnitude sufficient to break the frangible joint.

In a preferred form of the invention, the connection of the tamper-indicating member to the second portion is effected at least with an anchor member which can be inserted into the second portion and retained therein. Preferably, a plug member is also provided on the tamper-indicating member. The tamper-indicating member can be pushed inwardly in a region adjacent the plug member so as to force the plug member into a receiving aperture in the second portion as the frangible joint is broken. The tamper-indicating member is retained in the inwardly displaced orientation as a further indication that the frangible joint has been broken. The retention of the tamper-indicating member in the inwardly displaced position also provides a space below an overhanging part of the first portion (e.g., lid) to accommodate a person's finger for lifting the first portion away from the second portion.

Thus, according to the present invention, the visible breakage of the frangible junction, as well as the displaced position of the tamper-indicating member, indicate to the consumer that the container has been previously opened or accessed. The dispensing structure, including body, lid, and tamper-indicating member, can be molded as a unitary, separate closure which is simply snap-engaged to the tamper-indicating ready condition. This closure can be cost effectively manufactured and installed on a container. The tamper-indicating member, when displaced during initial opening, provides finger access to an overhanging portion of the lid which facilitates repeated, easy lifting of the lid to an open position for dispensing.

Numerous other advantages or features of the present invention will become readily apparent from the following detailed description of the invention, from the claims, and from the accompanying drawings.

DETAILED DESCRIPTION OF THE PREFERRED EMBODIMENTS

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

Figure 1:
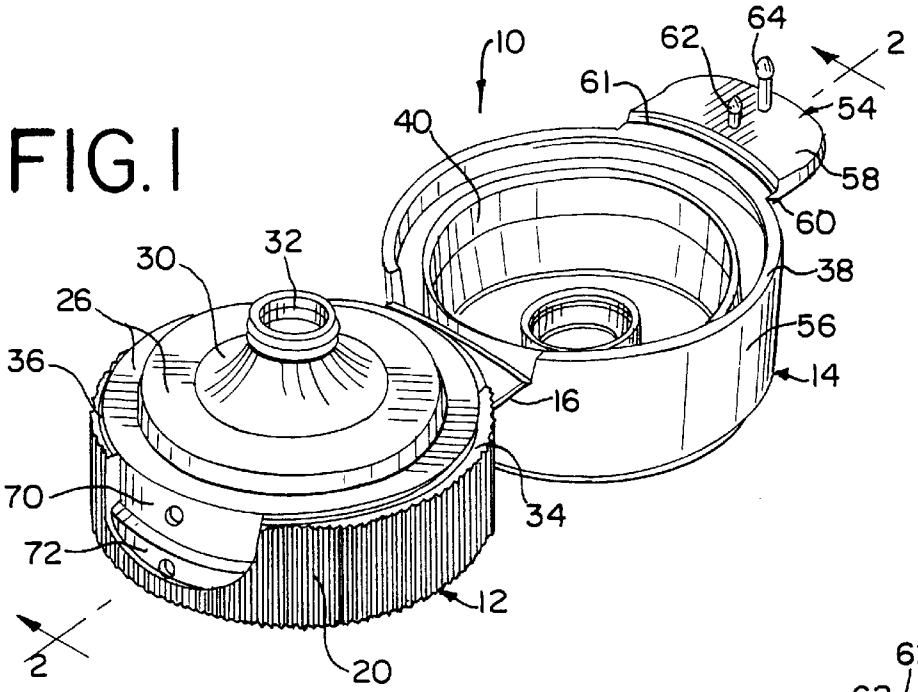
FIG. 1 is a perspective view of an unassembled closure embodying the teachings of the present invention.
Figure 2:
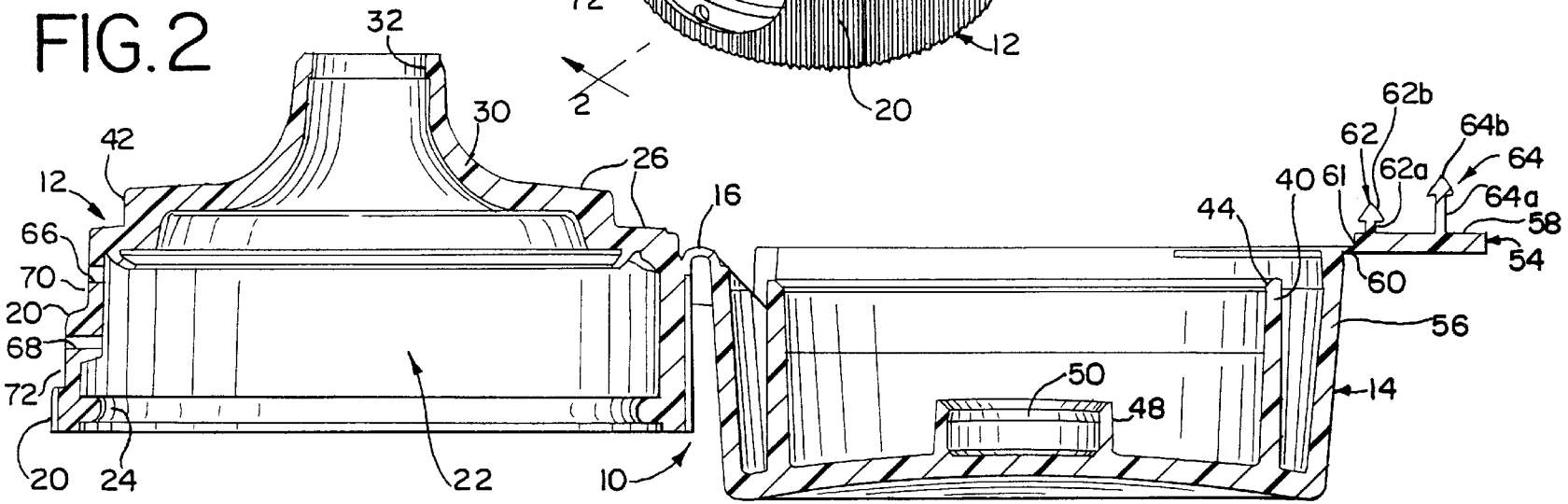
FIG. 2 is an enlarged, cross-sectional view of the closure taken generally along the plane 2—2 in FIG. 1.

FIGS. 1 and 2 illustrate a dispensing structure such as a closure 10 which includes a first portion or lid 14 and a second portion or body 12. The lid 14 is connected by a hinge 16 to the body 12. Preferably, the hinge 16 is a snap-action hinge formed integrally with the lid 14 and body 12 in a molded unitary structure. The illustrated snap-action hinge 16 may be a conventional type described in U.S. Pat. No. 4,403,712. Other hinge structures may be employed, including a "floppy" living film hinge. However, it is preferable to employ a snap-action hinge so as to be able to readily maintain the hinge and lid in the open position during dispensing of a liquid from the container.

The lid 14 can be tethered to, or completely removable from, the closure body 12. Also, the body 12 of the dispensing structure or closure 10 of the present invention may be formed as a unitary part of the container (not shown).

The body 12 includes a skirt 20 defining a lower opening 22 (FIG. 22). The skirt 20 is adapted to surround and engage a container (not shown). The skirt 20 includes a bead or snap ring 24 (FIG. 2) which secures the body 12 to a corresponding bead or groove provided on the container (not shown). Alternatively, the skirt 10 can be attached to a threaded container with a threaded connection. The skirt 20 could also be formed as an integral or unitary extension of, or part of, the container.

A deck 26 (FIGS. 1 and 2) extends radially inwardly from the upper end of the skirt 20. As shown in FIG. 2, the deck 26 includes an upwardly extending cylindrical wall 42 and a nozzle 30 defining a dispensing orifice 32. Outwardly of the deck 26, the upper end of the skirt 20 defines lateral shoulders or side ledges 34, 36 (FIG. 1).

Figure 4:
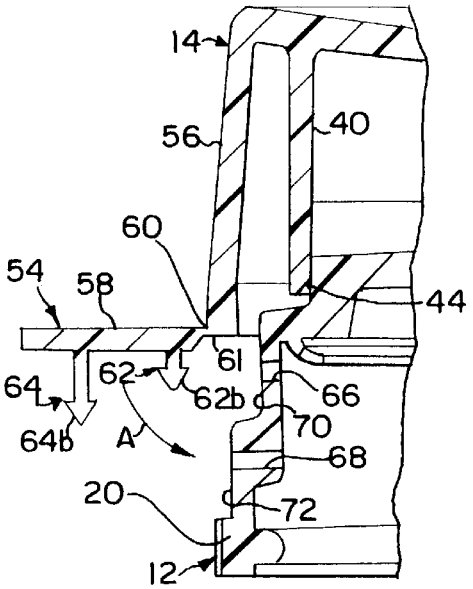
FIG. 4 is a cross-sectional view of the closure taken generally along the plane 4—4 in FIG. 3.
Figure 6:
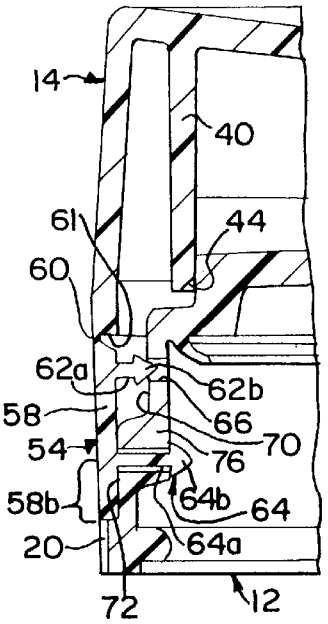
FIG. 6 is an enlarged, cross-sectional view of the closure taken generally along the plane 6—6 of FIG. 5.
Figure 8:
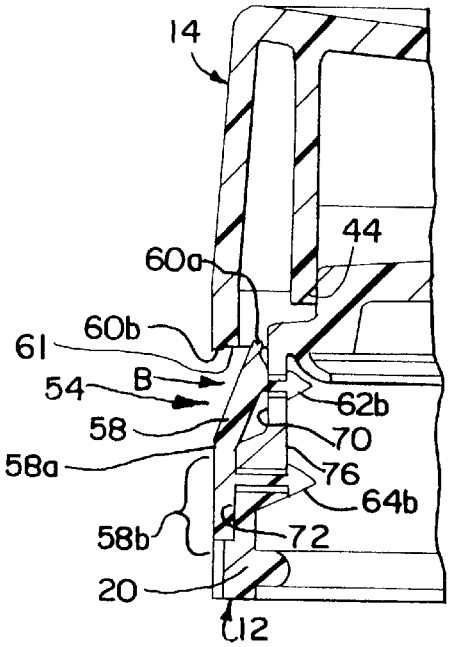
FIG. 8 is an enlarged, cross-sectional view of the closure taken generally along the plane 8—8 in FIG. 7.
Figure 9:
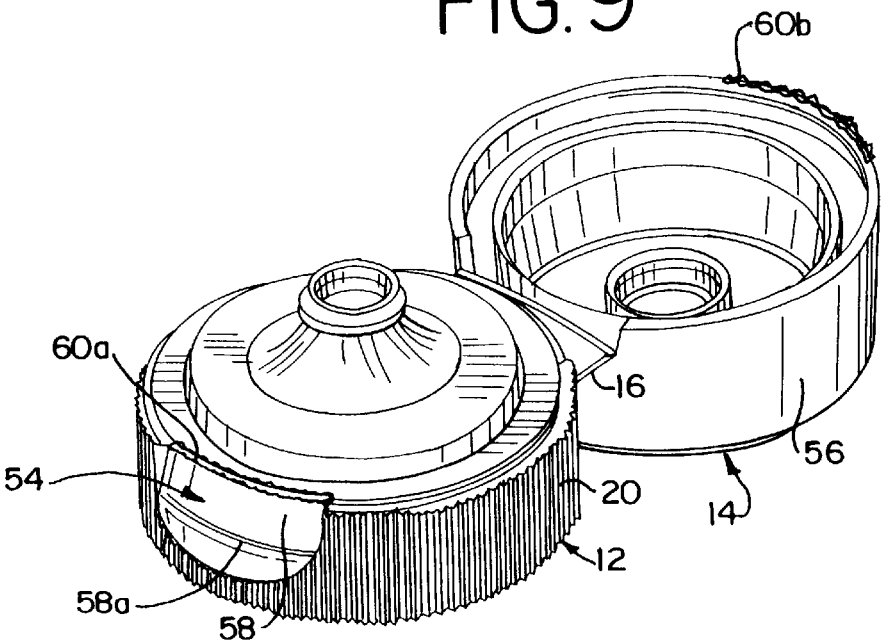
FIG. 9 is a perspective view of the closure with the lid opened.

The lid 14 includes a bottom surface 38 (FIG. 1) which abuts the side ledges 34, 36 when the lid 14 is closed to the body 12. The lid 14 also includes a locating ring 40 with a beveled edge 44 which is sized to slide down around the cylindrical wall 42 of the deck 26 (as shown in FIGS. 4, 6, and 8).

The lid 14 further includes a seal collar 48 (FIG. 2) having a sealing bead 50 on an inside surface thereof. The bead 50 seals around the nozzle 30 when the lid is closed over the body 12.

The lid 14 has an outer, peripheral wall 56 (FIGS. 1 and 2). A tamper-indicating member 54 extends from a front portion of the lid wall 56. The tamper-indicating member 54 includes a panel or wall 58 connected to the lid 14 by a frangible web or junction 60 (FIGS. 1–4 and 6). In the preferred embodiment, the well or panel 58 is somewhat flexible.

Figure 3:
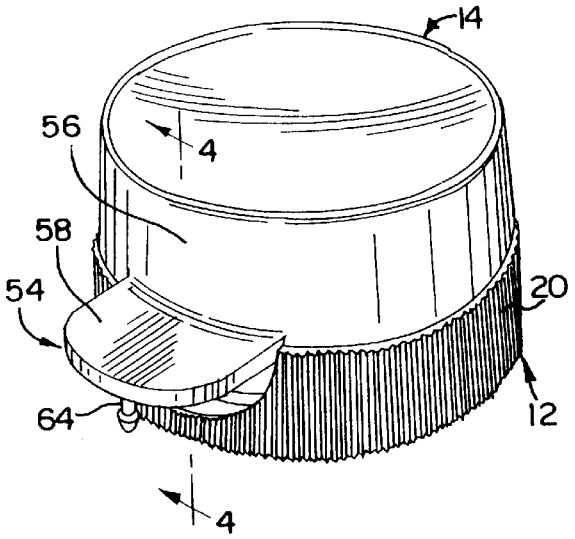
FIG. 3 is a perspective view of the closure in a partially assembled state.

In the embodiment illustrated, the closure 10 is molded as a unitary structure from a thermoplastic material, such as polyethylene or polypropylene. Typically, the closure 10 is molded in the open condition as illustrated in FIGS. 1 and 2. Subsequently, the closure lid 14 is closed over the closure body 12 (as shown in FIG. 3). Then, the tamper-indicating member 54 is pivoted to the downwardly extending position illustrated in FIG. 5 wherein the tamper-indicating member 54 is retained on the body skirt 20 by a unique system described in detail hereinafter. The above-described steps are performed by the closure manufacturer prior to mounting the closure on the container.

The flexible wall or panel 58 is preferably curved to match the outside contours of the body 12 and lid 14. The frangible junction 60 is preferably molded with closure 10 as a reduced thickness section of material preferably defined by an interior notch or groove 61 (FIGS. 4 and 6). The frangible junction 60 could also be an intentionally weakened junction created by partially cutting through a thickness of the frangible junction 60 with perforations, scoring, indentations, or created by material selection, tapering, or other means to define an easily breakable junction between the flexible wall 58 and the lid 14.

Extending from the flexible wall 58 are a plug member 62 (FIG. 1) and an anchor member 64 (FIG. 2). The plug member 62 and the anchor member 64 each have elongated stems 62*a* and 64*a*, respectively, with enlarged, conical heads 62*b* and 64*b*, respectively.

The skirt 20 includes a plug member-receiving aperture 66 (FIG. 2) and an anchor member-receiving aperture 68 (FIG. 2). The aperture 66 is located within a first recess 70 in the skirt 20. The aperture 68 is located in a second recess 72 in the skirt 20. Each of the apertures 66 and 68 has a diameter slightly smaller than the diameter of the conical heads 62*b* and 64*b*, respectively. The heads 62*b* and 64*b* can be pushed through the apertures owing to the resilient deformation of the heads and/or resilient stretching of the skirt 20 around the apertures. Thus, the tapered conical surfaces of the heads 62*b* and 64*b* can temporarily stretch open the apertures, or the heads can be temporarily deformed, so as to accommodate insertion of the heads. The apertures 66 and 68 and/or the heads 62*b* and 64*b* return to their original, undeformed shapes once the heads have passed through the skirt 20 to a back side of the apertures so as to retain the stems 62*a* and 64*a* in the skirt 20.

The first recess 70 extends deeper into the skirt 20 than does the second recess 72. The second recess 72 is sized to receive a lower portion of the tamper-indicating wall 58 which is designated as an anchor region or connection region 58*b* (FIGS. 6 and 8). This permits the flexible wall 58 and the skirt 20 to have substantially flush outer surfaces (FIG. 5).

During assembly, when the lid 14 is initially closed over the body 12 as shown in FIGS. 3 and 4, the flexible wall or panel 58 is in a first, as-molded position extending outwardly from the front of the lid peripheral wall 56. The flexible wall 58 is subsequently forcibly rotated downwardly in the direction A (FIG. 4) to engage the anchor member 64 in the anchor member-receiving aperture 68 of the body skirt 20. In the illustrated preferred embodiment, the flexible wall 58 generally pivots about the frangible web or junction 60 as the wall 58 is rotated downwardly.

Figure 5:
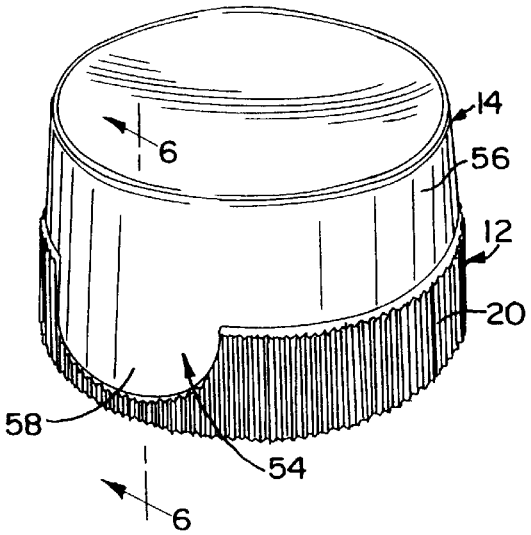
FIG. 5 is a perspective view of the closure in the final assembly configuration.

FIGS. 5 and 6 illustrate the closure 10 after the flexible wall 58 has been pivoted downwardly and anchored to the body skirt 20. The closure 10 is in a tamper-indicating ready condition wherein it is ready to be first opened by a user. The length of the anchor member stem 64*a* is such that the head 64*b* can be forced through the aperture 68 and locked in place against an inside surface 76 of the skirt 20. The conical head 64*b* is of a size, material, and shape such that the conical head 64*b* cannot be pulled outwardly from the aperture 68 without breaking or tearing either the head 64*b* or the skirt 20. The anchor member 64 fixes the anchor region or connection region 58*b* of the flexible wall 58 to the body 12 at a location which is below, but adjacent, the first recess 70. The upper part of the flexible wall member 58 defines an unsupported span over the first recess 70 from the anchor region 58*b* to the frangible junction 60.

The plug member 62 is of a shorter length than the anchor member 64. Owing to the deeper recess 70, the plug member 62 is not initially received completely through the plug member-receiving aperture 66 as can be seen in FIG. 6.

Figure 7:
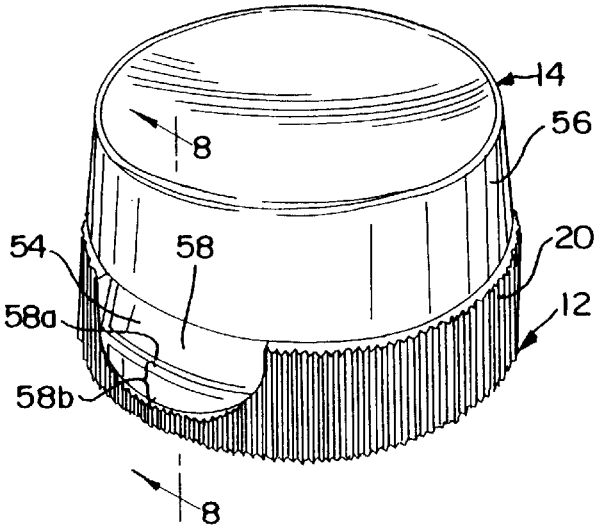
FIG. 7 is a perspective view of the closure after a tamper-indicating portion has been manipulated to permit the closure lid to be opened.

As illustrated in FIGS. 7 and 8, when the closure 10 is to be opened for the first time, the flexible wall 58 is forcibly depressed, (i.e., pushed inwardly) in the direction B. The wall 58 bends about a deflection region, bend region, or transverse region 58*a* (FIG. 8). The frangible junction 60 is thereby broken and separated into free edges 60*a* and 60*b* (FIG. 8). The plug member 62 enters the plug member-receiving aperture 66, and the head 62*b* is forced through the aperture 66 (by resiliently distorting either the head and/or aperture) so that the head 62*b* becomes positioned behind, and retained against, the inside surface 76 of the skirt 20. The plug member 62 thus functions as a latch when fully inserted into the aperture 66.

The lid 14 can subsequently be pried open by pushing upwardly with a finger against the overhanging edge of the lid 14 defined along the broken edge 60*a* above the space created by the inward movement of the flexible wall 58. The flexible wall 58 remains bent about the transverse deflection region 58*a* as the upper part of the wall 58 is held in the recess 70 against the lid skirt 20 by the engaged plug member 62.

Although elongate, cylindrical stems 62*a* and 64*a* and arrow-head-shaped or conical-shaped heads are depicted in the figures, other engagable shapes can be used for the plug member 62 and the anchor member 64 in accordance with the teachings of the present invention. For example, a hook-shaped head or a mushroom-shaped head can be used. Alternatively, the anchor member 64 can be replaced by an adhesive connection, a sonic welded connection, or other type connection between the tamper-indicating member 54 and the body 12.

Although a single anchor member 64 and a single plug member 62 are depicted, it is within the scope of the invention to provide multiple plug members which may, for example, each be identical with the plug member 62. The invention also contemplates the use of multiple anchor members which may, for example, each be identical with the anchor member 64. In one such contemplated embodiment, three such plug members and three such anchor members can be arranged in two rows extending from the flexible wall 58. The skirt 20 would then have three corresponding plug member-receiving apertures and three corresponding anchor member-receiving apertures arranged in two corresponding rows. Multiple plug members and anchor members may provide a more secure attachment of the flexible wall 58 to the skirt 20 as well as a more secure holding of the flexible wall 58 in its displaced position after the initial breaking of the tamper-indicating member frangible web 60.

Alternatively, the above-described single or multiple anchor members and plug members may be replaced by laterally extending wall-like members wherein each wall-like member has an enlarged distal end in the form of a continuous head with a triangular cross-section. Such wall-like members could each have a transverse cross section corresponding to the transverse cross section of the plug member 62 and anchor member 64 as shown in FIG. 2, but each wall-like member would be laterally elongated in a direction into and out of the plane of FIG. 2. The conical heads 62*b* and 64*b* of the plug member 62 and anchor member 64, respectively, would be replaced with triangular end portions each having a triangular cross section, or other enlarged cross-sectional shapes, and the cylindrical stems 62*a* and 64*a* would each be replaced with a plate-shaped, projecting wall. Within the recesses 70 and 72, the skirt 20 would define elongated slots for receiving the enlarged end portions of the wall-like members which function as the anchor member and plug member.

As can be understood from the above description of the various embodiments, the invention provides a tamper-indicating structure which advantageously retains the tamper-indicating member 54 in a unique configuration on the structure without creating a separately disposable scrap piece. The body 12, lid 14, and tamper-indicating member 54 can be advantageously molded from thermoplastic material as a unitary structure. The frangible junction 60 can be created by the molding process or after molding by other processes.

Although the depicted panel or wall 58 bends about the bend region 58*a* to its displaced position within the recess 70, it is within the scope of the invention that the wall 58 could be replaced with a two-part wall which more distinctly pivots about a defined axis rather than bends gradually in a curved configuration.

The invention could also employ other modes of movement of the tamper-indicating member 54, such as sliding or twisting, in order to break the frangible junction 60. It is also within the scope of the invention that the relative position between the anchor region 58*b* and the frangible joint 60 can be reversed such that the tamper-indicating member 54 is broken from a body of the dispensing structure and is retained on the lid of the dispensing structure after the initial opening.

It will be readily observed from the foregoing detailed description of the invention and from the illustrations thereof that numerous other variations and modifications may be effected without departing from the true spirit and scope of the novel concepts or the principles of this invention.

What is claimed is:

1. A tamper-indicating arrangement for a container, comprising:

a first portion and a second portion relatively movable to permit dispensing of material out of said second portion; and a tamper-indicating member which is adapted to be laterally pushed with a finger to a laterally displaced position, which is connected at a frangible joint to said first portion, at least a part of said tamper-indicating member being spaced from a part of said second portion to define a clearance for accommodating laterally displacement of said part of said tamper-indicating member, and which is connected to said second portion to allow said part of said tamper-indicating member to be pushed toward said second portion and relative to said first portion through a distance sufficient to break said frangible joint.

2. The arrangement according to claim 1 wherein said tamper-indicating member includes a latch which engages said second portion to hold said tamper-indicating member in a laterally displaced position after breaking said frangible joint.

3. A tamper-indicating arrangement for a container, comprising:

a first portion and a second portion at least partially separatable to permit dispensing of material out of said second portion;

a tamper-indicating member connected to said first portion and said second portion, said tamper-indicating member connected to said first portion at a frangible joint and connected to said second portion to allow relative laterally displacement between at least a part of said tamper-indicating member and said first portion of a magnitude sufficient to break said frangible joint; and a hinge;

said first portion being pivotally connected with said hinge to said second portion to accommodate separation of said first portion from said second portion by effecting relative pivoting movement between said first and second portions;

said tamper-indicating member being located on a side of said arrangement diametrically opposite from said hinge; and said tamper-indicating member being flexibly connected to said second portion and movable inwardly in a direction toward said hinge to break said frangible joint.

4. The arrangement according to claim 3 wherein said tamper-indicating member includes a plug member;

said second portion includes an aperture; and said plug member is engageable with said aperture when said tamper-indicating member is displaced to fracture said frangible joint whereby said tamper-indicating member is held in a displaced position.

5. The arrangement according to claim 4 wherein said first portion comprises a lid and said second portion effectively functions as a top wall portion of a container, the top wall portion having a dispensing orifice selectively closable by said lid; and said tamper-indicating member comprises a panel which is bendable.

6. The arrangement according to claim 1 wherein said tamper-indicating member includes a panel and a plug member extending therefrom, said plug member having a stem connected at one end to said panel, said plug member having an enlarged head at an end of said stem opposite said one end; and said second portion defines a plug member-receiving aperture aligned with said head and sized to permit resilient penetration of said head through said plug member-receiving aperture to establish a connection between said plug member and said panel when said [temper]tamper-indicating member is displaced relative to said first portion.

7. The arrangement according to claim 6 wherein said enlarged head of said plug member is cone shaped.

8. The arrangement according to claim 1 wherein said tamper-indicating member includes a panel and an anchor member extending from said panel, said anchor member having a stem connected at one end to said panel, said anchor member having an enlarged head at an end of said stem opposite said one said; and said second portion defines an anchor member-receiving aperture aligned with said anchor member and sized to permit resilient penetration of said enlarged head therethrough to establish a connection between said anchor member and said second portion.

9. The arrangement according to claim 8 wherein said enlarged head of said anchor member is cone shaped.

10. The arrangement according to claim 1 wherein said tamper-indicating member includes a panel and a plug member extending therefrom, said plug member having a first stem connected at one end to said panel, said plug member having an enlarged first head at an end of said first stem opposite said first stem one end, said first head having a first engaging surface;

said second portion having a wall having a plug-receiving aperture aligned with said first head and sized to permit resilient penetration of said first head through said plug member-receiving aperture to bring said first engaging surface into engagement with said second portion wall when said tamper indicating member is laterally displaced relative to said first portion; and said tamper-indicating member includes an anchor member extending from said panel, said anchor member having a second stem connected at one end to said panel, said anchor member having an enlarged, second head at an end of said second stem opposite said second stem one end, said second head having a second engaging surface, and said wall of said second portion having an anchor member-receiving aperture aligned with said anchor member and sized to permit resilient penetration of said enlarged second head therethrough whereby said second engaging surface engages said second portion wall to connect said tamper-indicating member to said second portion.

11. The arrangement according to claim 10, wherein said enlarged first and second heads are cone shaped.

12. A closure structure for a container, comprising:

a body having, a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member which is adapted to be laterally pushed with a finger and which is frangibly connected at a frangible junction to said lid and connected in a connection region to said body to allow at least part of said tamper-indicating member to be laterally pushed toward said body and relative to said body a distance sufficient to separate said tamper-indicating member from said lid, at least a part of said tamper-indicating member being spaced from a part of said body to define a clearance for accommodating laterally displacement of said part of said tamper-indicating member when pushed.

13. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member frangibly connected at a frangible junction to said lid and connected in a connection region to said body whereby part of said tamper-indicating member can be moved sufficiently relative to said body to separate said tamper-indicating member from said lid;

said body containing wall including a deck and a surrounding skirt;

said tamper-indicating member having a first side;

said connection region being located on said first side of said tamper-indicating member; and said tamper-indicating member including a panel extending effectively unsupported from said connection region to said frangible junction, said panel extending adjacent, but spaced from, said body to accommodate lateral displacement of said panel when said panel is pushed toward said body so as to separate said tamper-indicating member from said lid.

14. The closure structure according to claim 13 wherein said body includes a recess adjacent said panel, said panel being deflectable into said recess when said frangible junction is broken.

15. The closure structure according to claim 14 wherein said tamper-indicating member includes a plug member projecting from said panel from a location between said connection region and said frangible junction;

said body includes an aperture which registers with said plug member; and said plug member is sized and shaped to be resiliently received in said aperture and held by said body.

16. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member frangibly connected at a frangible junction to said lid and connected in a connection region to said body whereby part of said tamper-indicating member can be moved sufficiently relative to said body to separate said tamper-indicating member from said lid;

said tamper-indicating member being separatable from said lid along said frangible junction when said tamper-indicating member is laterally displaced towards said body whereby a finger-engageable overhang is then defined by said lid with respect to said body.

17. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member which is adapted to be laterally pushed with a finger and which is frangibly connected at a frangible junction to said lid and connected in a connection region to said body to allow at least part of said tamper-indicating member to be laterally pushed toward said body and relative to said body a distance sufficient to separate said tamper-indicating member from said lid;

said tamper-indicating member having an anchor member; and said body having an anchor member-receiving aperture for receiving said anchor member to lock said tamper-indicating member to said body.

18. A closure structure for a container, comprising:

a body having a containing wall for closing the container and having a dispensing orifice through said containing wall;

a lid operatively associated with the containing wall to cover said dispensing orifice in a closed position and uncover said dispensing orifice when said lid is moved away from said closed position; and a tamper-indicating member frangible connected at a frangible junction to said lid and connected in a connection region to said body whereby part of said tamper-indicating member can be moved in a lateral direction sufficiently relative to said body to separate said tamper-indicating member from said lid;

said tamper-indicating member having a deflection region accommodating bending; and said frangible junction being located at a predetermined distance from said deflection region.

* * * * *